US005964376A

United States Patent [19]

Kenosha

[11] Patent Number: 5,964,376

[45] Date of Patent: Oct. 12, 1999

[54] INVERTED BOTTLE SUPPORT AND DISPENSER APPARATUS AND METHODS OF MAKING AND USING THE SAME THEREOF

[76] Inventor: William J. Kenosha, 2539 N. 48th St., #206, Phoenix, Ariz. 85008

[21] Appl. No.: 08/795,154

[22] Filed: Feb. 7, 1997

[51] Int. Cl.[6] ..... B67D 1/16

[52] U.S. Cl. ..... 222/1; 222/185.1; 222/525

[58] Field of Search ..... 222/1, 212, 185.1, 222/525, 523, 522

[56] References Cited

U.S. PATENT DOCUMENTS

| | | | |
|---|---|---|---|
| 3,141,579 | 7/1964 | Medlock | 222/212 |
| 4,297,363 | 10/1981 | Lesher et al. | 424/263 |
| 4,715,516 | 12/1987 | Salvail | 222/153 |
| 4,875,663 | 10/1989 | Forestier | 266/272 |
| 4,903,742 | 2/1990 | Gagnon | 141/353 |
| 4,909,417 | 3/1990 | Ripley | 222/145 |
| 5,211,314 | 5/1993 | Burrows | 222/185 |
| 5,330,080 | 7/1994 | O'Connor | 222/181 |
| 5,379,813 | 1/1995 | Ing | 141/351 |
| 5,431,305 | 7/1995 | Kaminski | 222/525 |
| 5,482,172 | 1/1996 | Braddock | 215/235 |
| 5,489,046 | 2/1996 | Wickham | 222/184 |
| 5,509,583 | 4/1996 | Dolson | 222/185.1 |

*Primary Examiner*—Steven O. Douglas

*Attorney, Agent, or Firm*—Steven Lin

[57] ABSTRACT

An inverted bottle support and dispenser apparatus 20, 21, 22, or 23 for allowing a bottle or container 30 to stand in a normally inverted resting position. The dispenser apparatus comprises at least two tier components wherein the at least two tier component slidingly move relative to each other. The first tier component has at least an opening, channel, or hole, and the second tier component has at least a rib or engaging component to correspondingly and insertingly engage with the opening, channel, or hole in the first tier component to provide at least an open dispensing position that allows the contents of the bottle or container 30 to be dispensed and a closed position to allow the contents of the bottle or container 30 to remain in the bottle or container 30. Furthermore, the at least two tier components can be positioned to provide an unlocked position and a locked position for the dispenser apparatus. One preferred embodiment is a three tier embodiment having a first tier component 40, a second tier component 50, and a third tier component 60. Another preferred embodiment is a two tier embodiment having a first tier component 40C or 40D and a second tier component 50C and 50D. A spring component 70 is used within the tier components to provide automatic retraction of the first tier component 40, 40C, or 40D to the second tier component 50, 50C, or 50D. Furthermore, a ventilation mechanism, such as a slide tab 81 on the bottle or a hollow tube 91 attached through the dispenser apparatus 20, 21, 22, or 23 and inserted inside the bottle, is used with the dispenser apparatus.

20 Claims, 7 Drawing Sheets

INVERTED BOTTLE SUPPORT AND DISPENSER APPARATUS AND METHODS OF MAKING AND USING THE SAME THEREOF

BACKGROUND OF THE INVENTION

1. Fields of the Invention

The present invention relates to a bottle support and dispenser apparatus, and, more particularly, relates to an inverted bottle support and dispenser apparatus for allowing a bottle to be set or placed in an inverted position on a surface and for allowing the user to readily dispense from the dispenser simply by lifting the bottle from the surface and squeezing the bottle.

2. Discussion of Background and Prior Art

A. Prior Art Conventional Bottles

Conventional bottles are used to contain and store many different liquids or liquid type substances (i.e. ketchup, mustard, shampoo, dishwashing detergent, etc.). Conventional bottles store or contain these liquids or substances in a manner in which the liquids or substances sit or rest at the bottom of the bottle and the opening for dispensing the liquids or substances is located at the top of the container. The bottle is in use when the user lifts the bottle and generally inverts it so that the contents of the bottle flows from the bottom of the bottle and towards the opening. Some bottles are made to be squeezable (i.e. made of a flexible plastic, etc.) that allows the user to aid in dispensing the contents from the bottle.

However, there are problems that are associated with conventional bottles. One problem with the conventional bottle is that when the contents, liquids, or substances reach the bottom of the bottle, then these contents, liquids, or substances need to flow from the bottom of the bottle to the opening, and the flow of these materials may take a long time to reach the opening depending on how viscous the contents, liquids, or substances are (i.e. high viscosity material taking a longer time than lower viscosity material). Therefore, in many instances, contents, liquids, or substances are wasted since they sit at the bottom of the bottle and get thrown out with the bottle since the user is inconvenienced or does not want to wait for the contents, liquids, or substances to flow out of the bottle.

In other instances in preventing waste, the user will leave bottles inverted or upside down so that the contents generally remain near the opening of the bottle and is ready to use. In other cases, the user will combine bottles in which the contents have reached the bottom by inverting and stacking one bottle over another right-side-up bottle so that the contents in the inverted bottle flow into and combine with the contents in the right-side-up bottle. This process of combining bottles is typically not appealing to most users and is also time consuming.

A further problem with the conventional bottle is that when it sits or rests in the right side up position, the contents tend to settle and the contents becomes thicker at the bottom of the bottle and thinner or more watery at the top of the bottle. When a user lifts the bottle to pour the contents, the contents that first flows out tends to be thinner or more watery. The user then has to shake the bottle before pouring out the contents.

B. Prior Art Inverted Bottle Support and Dispensers

Inverted bottle supports and dispensers have been more recently developed to provide advantages and to overcome some of the disadvantages that exist with the conventional (i.e. right-side-up) bottle. A few types of bottles or containers that are in a generally inverted position when placed or set on a surface and that allow the contents of the bottle to generally remain near or at the dispensing area of the bottle do exist. One type of inverted bottle support and dispenser that exists is one which has a container that has a dispenser opening and adjacent flat supports at one end and a cap that has a flip up and down recessed spout wherein the spout flips to an open position for dispensing and into a closed position for storing. When the spout is flipped to the closed position, the cap has a generally flat exterior surface that is flush with the supports so that the bottle can be invertedly supported by the cap and flat supports on a surface. The bottle or container has a vent hole at the top of the container for allowing air to be drawn into the container after dispensing (i.e. by user squeezing the bottle) in order to return the container to its general and original normal state. U.S. Pat. No. 5,489,046 to Wickham ("Wickham") provides an example of such a bottle support and apparatus. One of the disadvantages of this type of inverted bottle support and dispenser is that the bottle must have or be modified to have a hole, aperture, or some type of vent opening to allow air to flow into its interior so that air is not trapped inside the bottle when the dispenser is closed (i.e. which may cause the bottle to be in a deformed condition) and so that the bottle can restore to its normal shape. The further disadvantage of having a hole, aperture, or opening in the bottle is that the contents may accidentally leak from that hole, aperture, or opening and/or that the contents do not stay fresh as long since it is always being exposed to air.

Another type of inverted bottle support and dispenser is one that uses a bottle with a cap large enough to support the bottle in an inverted position wherein the cap is a flip top. When the bottle is not in use, the cap is flipped up into a closed position and the flat side of the cap of the bottle sits or rests on a surface so that the contents in the bottle are generally near or at the cap. The user lifts the bottle from the surface and flips down the cap into an open position to allow the contents to flow out of the bottle. "I CAN'T BELIEVE IT'S BUTTER" company provides an example of this type of bottle since it manufactures and sells such a bottle for the dispensing of a butter product. However, one of the disadvantages of this type of inverted bottle support and dispenser is that the dispenser requires the manual flipping of the cap, and the bottle does not automatically dispense its contents when the user lifts the bottle.

A further type of inverted bottle support and dispensers is one that uses a bottle with a flexible diaphragm which has slit openings and provides a valve action for dispensing the contents inside of the bottle. The diaphragm is centrally located at the dispensing side of the dispenser. The diaphragm is located inside or at least flush to the dispensing side which is flat to allow the bottle to sit and rest on a surface so that the contents in the bottle are generally near or at the cap. The user lifts the bottle from the surface and squeezes the bottle so that contents flow out of the diaphragm opening, and the user releases the bottle after the appropriate amount of contents has been dispensed wherein the release causes the air to flow back through the diaphragm opening and allow the bottle to return to its generally normal shape. The user then places the flat dispensing side of the bottle down on the surface again. Aussie company provides such an example of this type of bottle since it manufactures and sells such a bottle for the dispensing of shampoo. The problem with this type of bottle support and dispenser is that a lock or securing position of the dispenser is not provided. Therefore, the problems of accidental dispensing or leaking of the contents from the bottle may still exist (i.e. there is a problem with placing this type of bottle in a travel or tote bag since pressure may be accidentally applied to the bottle which may cause undesired dispensing of the contents).

Therefore, the need to provide a new and improved inverted bottle support dispenser apparatus exists. An inverted bottle support and dispenser that provides easy and convenient ventilation of the bottle and does not allow leaking or aids in preventing staleness of the contents in the bottle does not exist. Furthermore, the continued need for improvement of inverted bottle support and dispenser that provides a secure closed and locked position, a closed and ready-to-dispense unlocked position, and a convenient open and unlocked dispensing position, of the dispenser also exists. Therefore, an inverted bottle dispenser apparatus and corresponding methods that overcome these disadvantages are desired, and it is an object of the present invention to overcome the problems and limitations of the background art that has been discussed.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

Accordingly, it is an object and advantage of the present invention to provide an inverted bottle support and dispenser apparatus for allowing a bottle having contents therein to be set in an inverted position on a surface that includes at least two tier components that are adapted to be attached to a dispensing end of the bottle wherein one of the at least two tier components slidingly moves within another of the at least two components and wherein the at least two components can move to an open position for dispensing the contents from the bottle and to a closed position to allow the contents to remain in the bottle and a support surface coupled to the at least two tier components to support the bottle in the inverted position.

One aspect and advantage of the present invention is to provide an inverted bottle support and dispenser apparatus wherein the at least two tier components are a first tier component, a second tier component, wherein a third tier component, is adapted to attach to the dispensing end of the bottle, wherein the second tier component is able to be slidingly positioned relative to the third tier component to provide an unlocked position and a locked position for the apparatus, wherein the first tier component is able to slidingly move within the second tier component to provide an open position and a closed position for the apparatus.

Another aspect and advantage of the present invention is to provide an inverted bottle support and dispenser apparatus wherein the at least two tier components are a first tier component and a second tier component, wherein the second tier component is adapted to attach to the dispensing end of the bottle, wherein the first tier component is able to be slidingly positioned relative to the second component to provide an unlocked position and a locked position for the apparatus, and wherein the first tier component is able to slidingly move within the second tier component to provide an open position and a closed position for the apparatus.

A further aspect and advantage of the present invention is to provide an inverted bottle support and dispenser apparatus that further comprises at least one bottle support component coupled to the at least two tier components to provide the support surface which supports the bottle in the inverted position.

A still further aspect and advantage of the present invention is to provide an inverted bottle support and dispenser apparatus that further comprises a spring component mounted within the at least two tier components for automatically retracting and biasly springing one of the at least two tier components to another of the at least two tier components.

A still further aspect and advantage of the present invention is to provide an inverted bottle support and dispenser apparatus that further comprises a ventilation mechanism or apparatus coupled to the at least two tier components for allowing air trapped in the bottle after the bottle has been squeezed by a user to be ventilated out of the bottle.

Another object and advantage of the present invention is to provide a method of making an inverted bottle support and dispenser apparatus for allowing a bottle having contents therein to be set in an inverted position on a surface that includes the steps of providing at least two tier components that are adapted to be attached to a dispensing end of the bottle wherein one of the at least two tier components slidingly moves within another of the at least two components and wherein the at least two components can move to an open position for dispensing the contents from the bottle and to a closed position to allow the contents to remain in the bottle and coupling a support surface to the at least two tier components to support the bottle in the inverted position.

A further object and advantage of the present invention is to provide a method of using an inverted bottle support and dispenser apparatus for allowing a bottle having contents therein to be set in an inverted position on a surface that includes the steps of providing a dispenser apparatus having at least two tier components which slidingly move relative to each other and having a support surface coupled to the at least two tier components to support the bottle in the inverted position and attaching the dispenser apparatus to the bottle, slidingly positioning the at least two tier components to an unlocked and open position for dispensing a desired amount of the contents from the bottle, squeezing the bottle to allow a desired amount of the contents to flow from the bottle when the dispenser apparatus is in the unlocked and open position, slidingly positioning the at least two tier components to an unlocked and closed position for preventing the contents from flowing out of the bottle and positioning the contents within the bottle and dispenser apparatus to a ready dispensing position, and slidingly positioning the at least two tier components to a locked and closed position for preventing the contents from entirely flowing out of the bottle.

DETAILED DESCRIPTION OF THE PREFERRED EMBODIMENT

Figure 1:
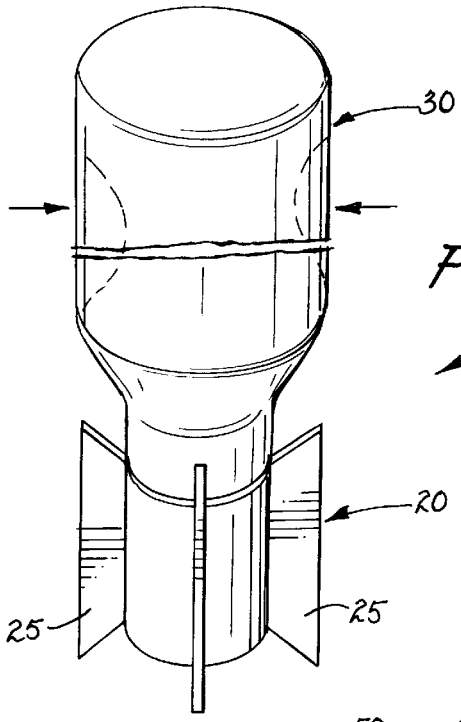
FIG. 1—Perspective view of a first three tier embodiment of the present invention in the resting position.

The present invention 10 generally discloses an inverted bottle support and dispenser apparatus 20 for allowing a bottle or container 30 to stand in a normally inverted resting position as shown in FIG. 1. The present invention 10 allows the contents of the bottle 30 to rest near the dispenser apparatus 20 at a position to be readily dispensed. The present invention has various embodiments and variations. However, the preferred embodiments of the present invention comprises at least two tier components wherein the first tier component generally slides and engages within the second tier component. The first tier component has at least an opening, channel, or hole, and the second tier component has at least a rib or engaging component to correspondingly and insertingly engage with the opening, channel, or hole in the first tier component to provide at least an open dispensing position that allows the contents of the bottle or container 30 to be dispensed and a closed position to allow the contents of the bottle or container 30 to remain in the bottle or container 30.

A. First and Second Embodiments of the Present Invention— Three Tier Embodiments One type of embodiment of the present invention is a three tier embodiment. The three tier embodiment has at least three tier components for the dispenser apparatus 20 wherein the components slidingly engage with each other to provide at least an open position for dispensing the contents of the bottle or container 30 and a closed position for storing or allowing the contents to remain in the bottle or container 30. Furthermore, the three tier embodiment provides a locked and unlocked position for dispensing the contents of the bottle or container 30.

Figure 2:
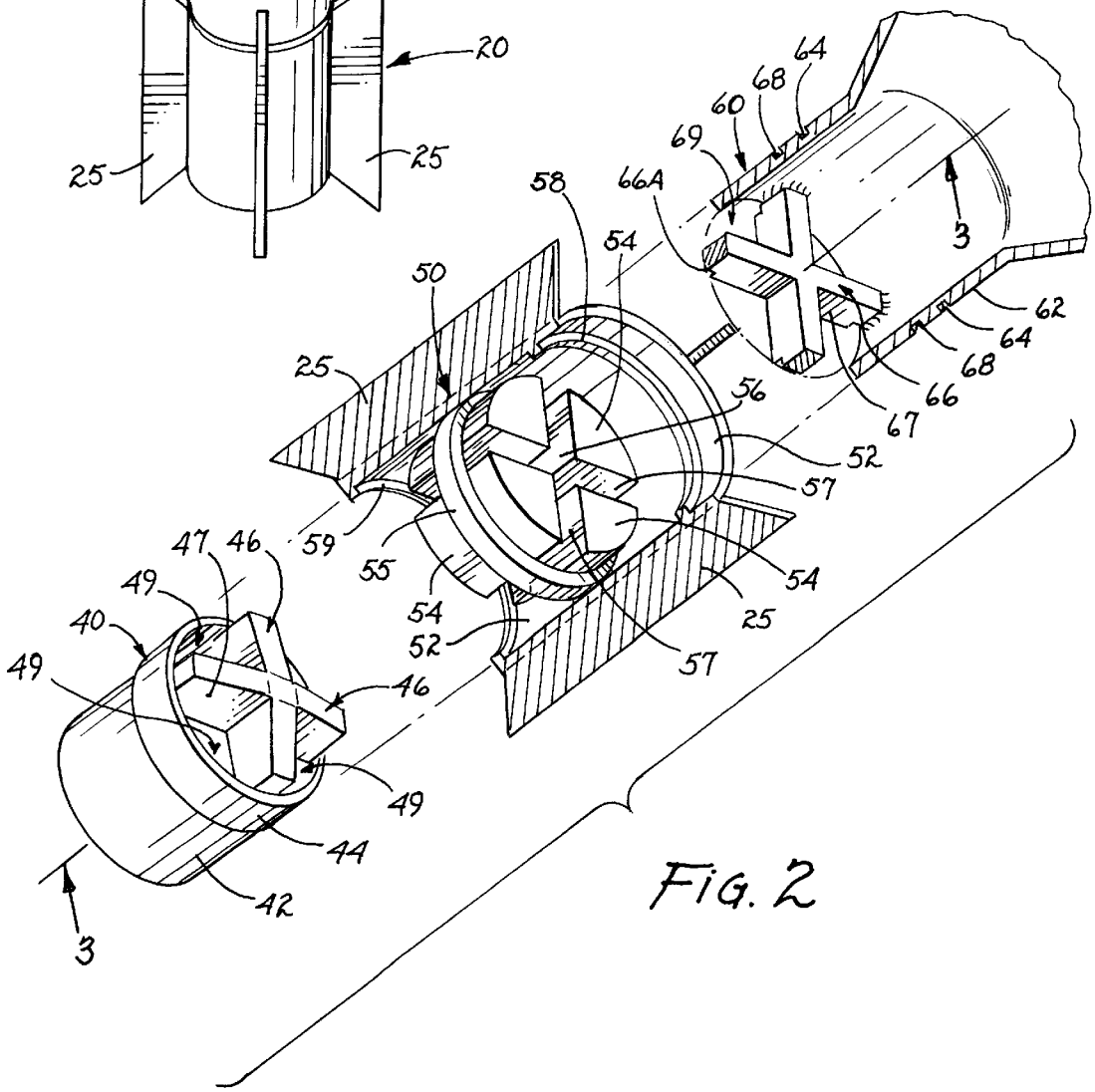
FIG. 2—Exploded partially cut away view of the dispenser apparatus components of the first embodiment wherein the dispenser apparatus is integrally attached to the bottle or container.

1. First Embodiment—Three Tier Integrally Attached Embodiment a. Components of the First Embodiment The first preferred embodiment of the present invention 10 is a three tier integrally attached embodiment generally having at least three tier components 40, 50, and 60 (i.e. first, second, and third tier components). FIGS. 2, 3, 4, 5, 6, 7, 7A, and 8 show various views of the first embodiment. In FIGS. 2, 3, 4, 6 and 8, the first embodiment shows that the third component 60 is integrally attached to the bottle or container 30. Thus, the first embodiment is called a three tier integrally attached embodiment. FIG. 2 clearly shows an exploded cutaway view of the three tier components 40, 50, and 60 while FIG. 3 clearly shows a cross-sectional side view of the same components.

1) First Tier Component

The first tier component 40 of the first embodiment is shown in the figures as a generally cylindrical and hollow body 42. An annular protruding area 44 exists on the cylindrical surface near an end of the hollow body 42. The first tier component 40 also has a first engaging component 46 located relatively near the same end of the protruding area 44. The engaging component 46 are two generally solid parts in the shape of a cross. The two solid parts have a sloping outward or upward surface towards the center of the cross. The engaging component 46 is mounted within the hollow body 42 such that openings 49 exist. The sloping surface aids in cleaning excess contents from the bottle or container 30 from the inner surfaces 47 which provides cleaner and better engagement of the engaging component 46 into a channel opening (i.e. at least help prevent the excess contents from remaining and sticking between the inner surfaces 47 of the engaging component 46 and the side walls 57 of channel opening 56 and preventing the first tier component 40 from sticking to the second tier component 50).

2) Second Tier Component

The second tier component 50 also has a generally cylindrical hollow body 52. The inner diameter of the hollow body 52 is slightly larger than the outer diameter of hollow body 42 so that the first tier component 40 is able to slidingly engage within the second tier component 50. A receiving component 54 that provides a channel opening 56 is centrally located within the hollow body 52. The channel opening 56 extends through the entire height of the component 54, and it is in the shape of a corresponding cross that receives the first engaging cross-shaped component 46 and a second engaging cross-shaped component 66 of a third tier component 60. When the dispenser apparatus 20 is in an open position, the contents of the bottle or container 30 is able to flow through the channel opening 56. The second tier component 50 also has an annular component 55 centrally attached around and between an outer perimeter of the receiving component 54 and an inner perimeter of the cylindrical hollow body 52. Furthermore, a circular engaging ring 58 is located relatively near the end close to the third tier component 60. The second tier component 50 also has a retaining ring component 59 near the end close to the first tier component 40 providing a perimeter edge to retain the first tier component 40 and allow sliding movement of it within the hollow body 52.

3) Third Tier Component

As stated earlier, the third tier component 60 is integrally attached to the bottle or container 30. The third tier component 60 has a generally cylindrical hollow body 62. The outer diameter of the hollow body 62 is slightly smaller than the inner diameter 52 so that the third tier component 60 is able to slidingly engage into the second component 50. The third tier component 60 also has the second engaging component 66 located near an end close to the second tier component 50. The engaging component 66 is also two generally solid parts in the shape of a cross. The engaging component 66 is mounted within the hollow body 62 such that openings 69 exist. The third tier component 60 has a first circular groove 64 located in an exterior perimeter of the hollow body 62 closer to the bottle or container 30 and has a second circular groove 68 also located in an exterior perimeter closer to the second tier component 50 of the hollow body 62.

4) Bottle Support Components

The dispenser apparatus 20 is able to support the bottle or container 30 in an inverted position in any suitable manner. One way that the bottle or container 30 is supported in the inverted position is simply by allowing it to rest on the first tier component 40. Another way that the bottle or container 30 is supported in the inverted position is to provide bottle supports or fins 25 attached to the side of dispenser apparatus 20 as shown in some of the figures. The bottle supports or fins 25, in effect, provide stands to aid in holding and supporting the bottle or container 30 in an upright, inverted position. FIG. 7A shows a circular component 26 for supporting a bottle or container in an upright, inverted position. Any suitable support or stand may be utilized for the present invention in supporting the bottle or container an upright, inverted position, which is not limited to those shown or described in the specification and figures.

b. Three Different Positions for the Three Tier Components

The three tier components 40, 50, and 60 of the dispenser apparatus 20 are slidingly engaged and attached to each other, and they generally slidingly move within one another. The first tier component 40 slidingly engages into one portion of the second tier component 50, and the third tier component 60 slidingly engages into another portion of the second tier component 50. The three tier components 40, 50, and 60 can be generally positioned in three different positions.

1) Unlocked and Open Position of the Dispenser Apparatus

Figure 4:
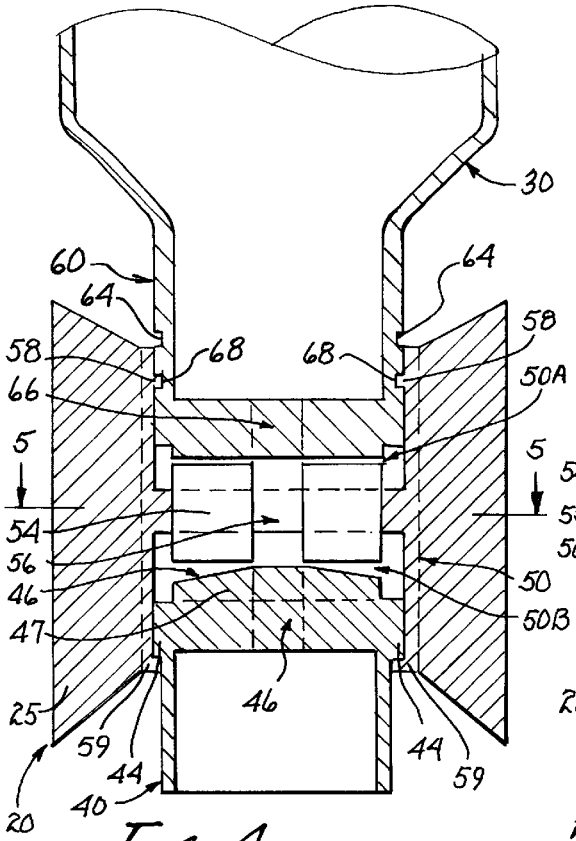
FIG. 4—Cross sectional side view of the dispenser apparatus components showing the dispenser in an unlocked and open position.
Figure 3:
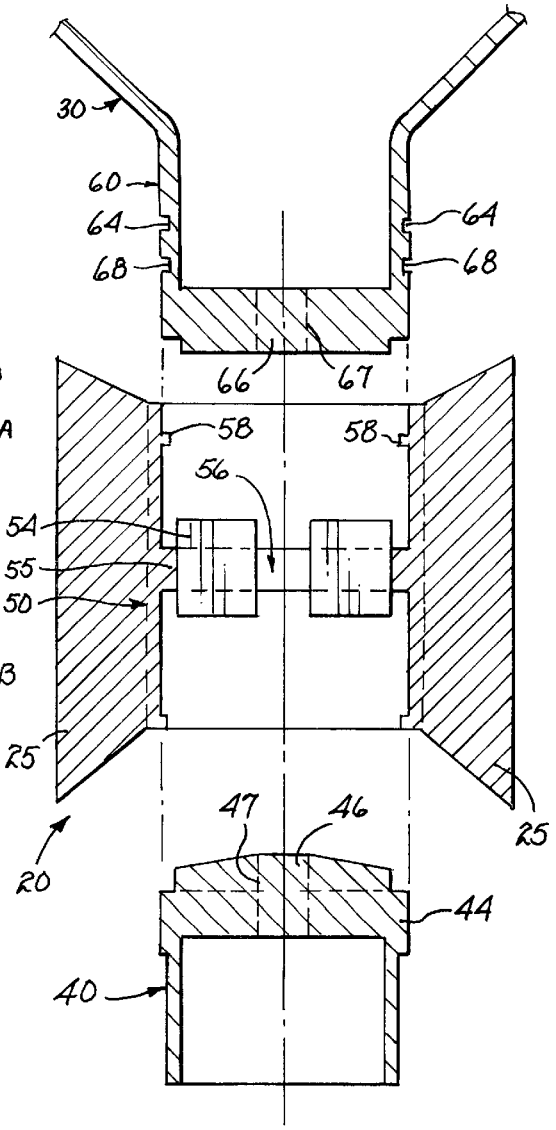
FIG. 3—Cross-sectional side view of the dispenser apparatus components according to the line 3—3 of FIG. 2.
Figure 5:
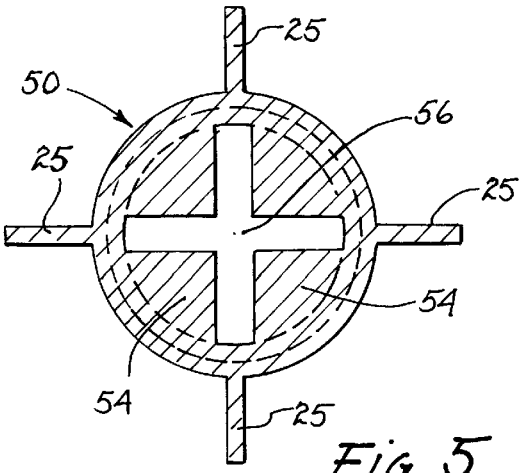
FIG. 5—Cross sectional view of the dispenser apparatus components according to the line 5—5 of FIG. 4.

Referring to FIGS. 4 and 5, the tier components 40, 50, and 60 of the dispenser apparatus 20 are shown in the unlocked and open position. The second tier component 50 is slidingly positioned relative to the third tier component 60 such that the retaining ring 58 of the second tier component 50 engages the circular groove 68 of the third tier component 60. The second tier component 50 is positioned relative to the third tier component 60 such that the second engaging component 66 is not engaged into the channel opening 56, and a gap 50A exists between the second and third tier components 50 and 60. The contents of the bottle or container 30 is then able to flow at least through the openings 69 (shown in FIG. 2) that exist near the engaging component 66 and to the channel opening 56. In other words, the dispenser apparatus 20 is in the unlocked position since the third tier component 60 is unlocked from the second tier component 50.

Furthermore, the first tier component 40 is slidingly positioned relative to the second tier component 50 such that the protruding area 44 of the first tier component 40 rests on the retaining ring component 59. The first engaging component 46 is not engaged into the channel opening 56 as well, and a gap 50B exists between the first and second tier components 40 and 50. The contents of the bottle or container 30 is then able to flow through the channel opening 56, through the openings 49 that exist near the engaging component 46, and out of the dispenser apparatus 20. In other words, the dispenser apparatus 20 is in the open position since the first tier component 40 is an open position relative to the second tier component 50 to allow contents to flow out of the bottle or container 30. Thus, the dispenser apparatus is in an unlocked and open position.

2) Locked and Closed Position of the Dispenser Apparatus

Figure 6:
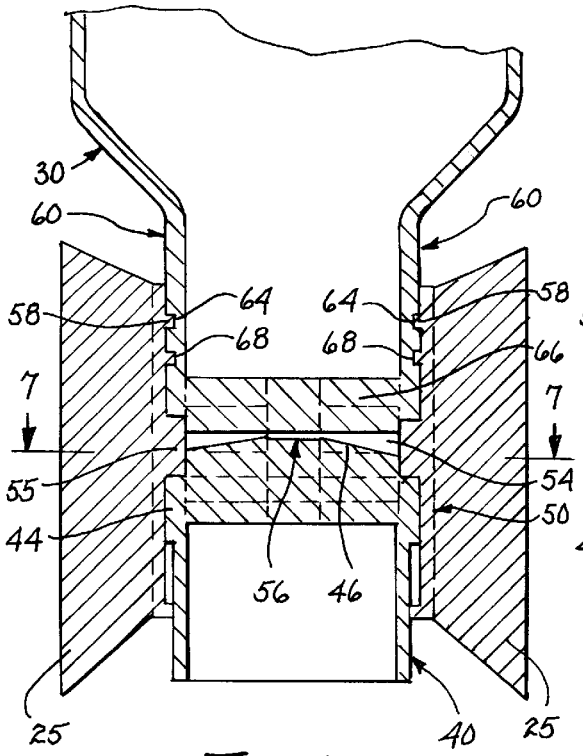
FIG. 6—Cross sectional side view of the dispenser apparatus components showing the dispenser in an locked and closed position.
Figure 7:
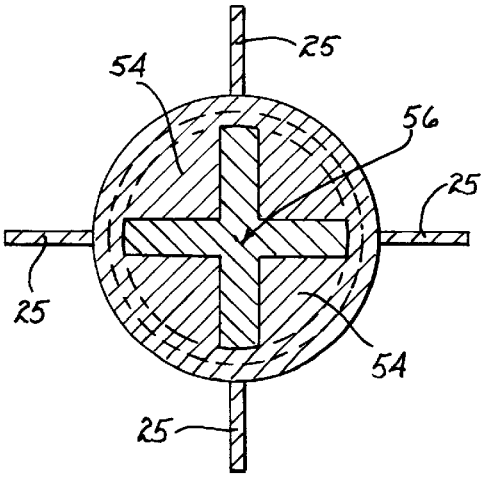
FIG. 7—Cross sectional view of the dispenser apparatus components according to the line 7—7 of FIG. 6.
Figure 7A:
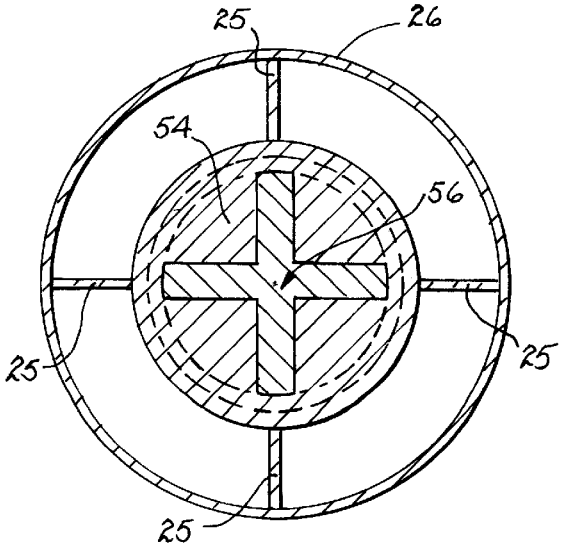
FIG. 7A—Cross sectional view of the dispenser apparatus components showing the dispenser in an unlocked and closed position and further showing a circular support component for supporting a bottle or container in an upright, inverted position.

Referring to FIGS. 6 and 7, the tier components 40, 50, and 60 of the dispenser apparatus 20 are shown in the locked and closed position. The second tier component 50 is slidingly positioned relative to the third tier component 60 such that the retaining ring 58 of the second tier component 50 engages the circular groove 64 of the third tier component 60. The second tier component 50 is positioned relative to the third tier component 60 such that the second engaging component 66 is engaged into the channel opening 56, and a gap 50A does not exist between the second and third tier components 50 and 60. In other words, the receiving component 54 of the second tier component 50 fills in the openings 69 near the engaging component 66, and the channel opening 56 of the second tier component 50 is closed off by the engaging component 66. The contents of the bottle or container 30 is prevented from flowing through any openings 69 or channel opening 56. The dispenser apparatus 20 is locked in position since the third tier component 60 is locked to the second tier component 50.

Furthermore, the first tier component 40 is slidingly positioned relative to the second tier component 50 such that the protruding area 44 of the first tier component 40 is slidingly positioned adjacent to the annular component 55 of the second tier component 50. The first engaging component 46 is engaged into the channel opening 56 as well, and a gap 50B does not exist between the first and second tier components 40 and 50. In other words, the receiving component 54 of the second tier component 50 fills in the openings 49 near the first engaging component 46, and the channel opening 56 of the second tier component 50 is closed off by the engaging component 46. The contents of the bottle or container 30 is further prevented from flowing through any channel opening 56 or openings 49. The dispenser apparatus 20 is in a closed position since the first and second tier components 40 and 50 are in a closed position that prevents contents from flowing out of the bottle or container 30. Thus, the dispenser apparatus is in a locked and closed position.

3) Unlocked and Closed Position of the Dispenser Apparatus

Figure 8:
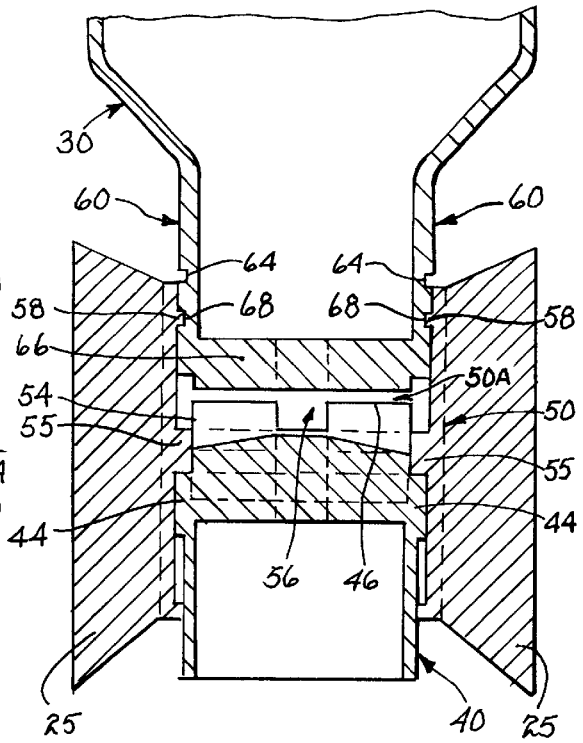
FIG. 8—Cross sectional side view of the dispenser apparatus components showing the dispenser in an unlocked and closed position.

Referring to FIGS. 7A and 8, the tier components 40, 50, and 60 of the dispenser apparatus 20 are shown in the unlocked and closed position. The second tier component 50 is slidingly positioned relative to the third tier component 60 such that the retaining ring 58 of the second tier component 50 engages the circular groove 68 of the third tier component 60. The second tier component 50 is positioned relative to the third tier component 60 such that the second engaging component 66 is not engaged into the channel opening 56, and a gap 50A exists between the second and third tier components 50 and 60. The contents of the bottle or container 30 is then able to flow at least through the openings 69 that exist near the engaging component 66 and to the channel opening 56. In other words, the dispenser apparatus 20 is in the unlocked position since the third tier component 60 is unlocked from the second tier component 50, and the contents of the bottle or container 30 are in a position ready to be dispensed.

However, the first tier component 40 is positioned relative to the second tier component 50 such that the protruding area 44 of the first tier component 40 is slidingly positioned adjacent to the annular component 55 of the second tier component 50. The first engaging component 46 is engaged into the channel opening 56 as well, and a gap 50B does not exist between the first and second tier components 40 and 50. In other words, the receiving component 54 of the second tier component 50 fills in the openings 49 near the first engaging component 46, and the channel opening 56 of the second tier component 50 is closed off by the engaging component 46. The contents of the bottle or container 30 is prevented from flowing through any channel opening 56 or openings 49. The dispenser apparatus 20 is in a closed position since the first and second tier components 40 and 50 are closed off so that the contents are prevented from flowing out of the bottle or container 30. Thus, the dispenser apparatus 20 is in an unlocked and closed position.

2. Second Embodiment—Three Tier Adaptable Version Embodiment

Figure 9:
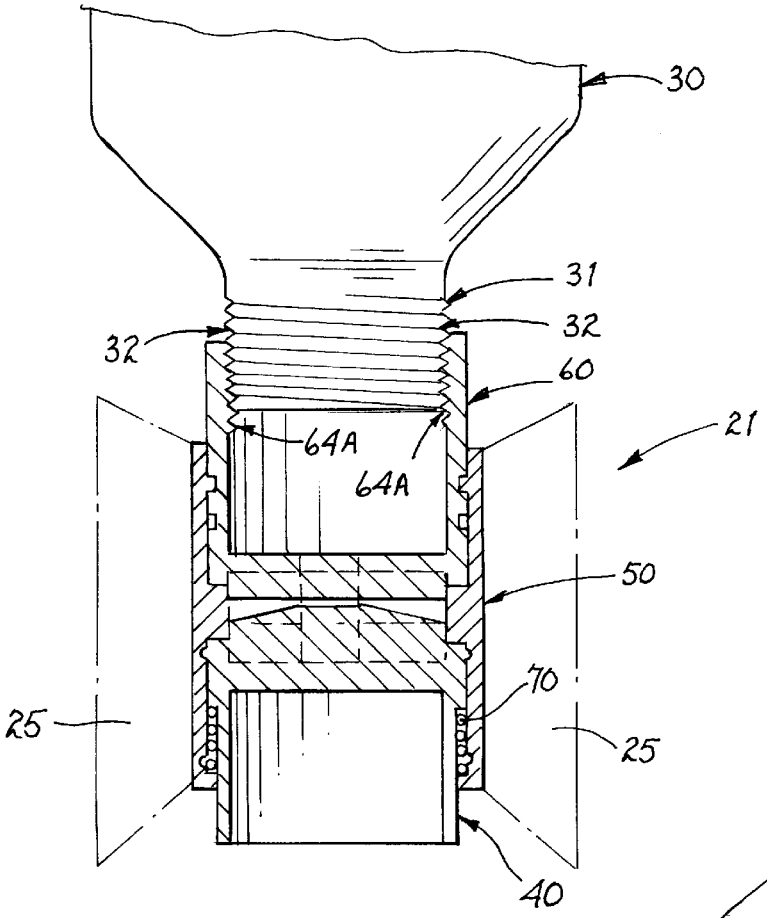
FIG. 9—Cross sectional side view of a second three tier embodiment of the present invention wherein the dispenser apparatus is adapted to receive a bottle or container.

FIG. 9 shows a second preferred embodiment of the present invention 10 which is a three tier adaptable version embodiment which is a dispenser apparatus 21 that is adapted to receive a bottle or container 30. The dispenser apparatus generally has at least three tier components 40, 50, and 60 (i.e. first, second, and third tier components). The second embodiment shows that the third component 60 is adapted to be received by a bottle or container 30, wherein the bottle or container 30 can be a pre-existing bottle and container that has a closable end 31 with threads 32.

The second preferred embodiment, which has a dispenser apparatus 21 for an adaptable version, is identical to the first preferred embodiment, which has a dispenser apparatus 20 for an integrally attached version, except that the third tier component 60 of the dispenser apparatus 21 does not have an integrally attached bottle nor the first and second grooves 64 and 68, but it instead has internal threads 64A within a portion of the hollow body 62 to adaptingly receive the threads 32 at end 31 of a bottle or container 30. In other words, the dispenser apparatus 21 is adapted to allow a bottle or container 30 to be screwed into and attached to it. The second preferred embodiment has all of the remaining features as the first preferred embodiment, and the second preferred embodiment can assume all of the same positions as the first preferred embodiment (i.e. unlocked and open; locked and closed; unlocked and closed).

B. Third and Fourth Embodiments of the Present Invention—Two Tier Emobidments

Another type of embodiment of the present invention is a two tier embodiment. The two tier embodiment has at least two tier components for a dispenser apparatus 22 or 23 wherein the components slidingly engage with each other to provide at least an open position for dispensing the contents of the bottle or container 30 and a closed position for storing or allowing the contents to remain in the bottle or container 30. Furthermore, the two tier embodiment can also provide a locked and unlocked position for dispensing the contents of the bottle or container 30. FIGS. 10–14 show two different two-tier embodiments of the present invention. These figures show two tier adaptable version embodiments. However, the present invention is not limited to just two tier adaptable version embodiments, but these two tier embodiments may also be in the form of integrally attached embodiments, which are not explicitly shown but are as similarly shown for the three tier embodiments in FIGS. 2, 3, 4, 6, and 8.

Figure 10:
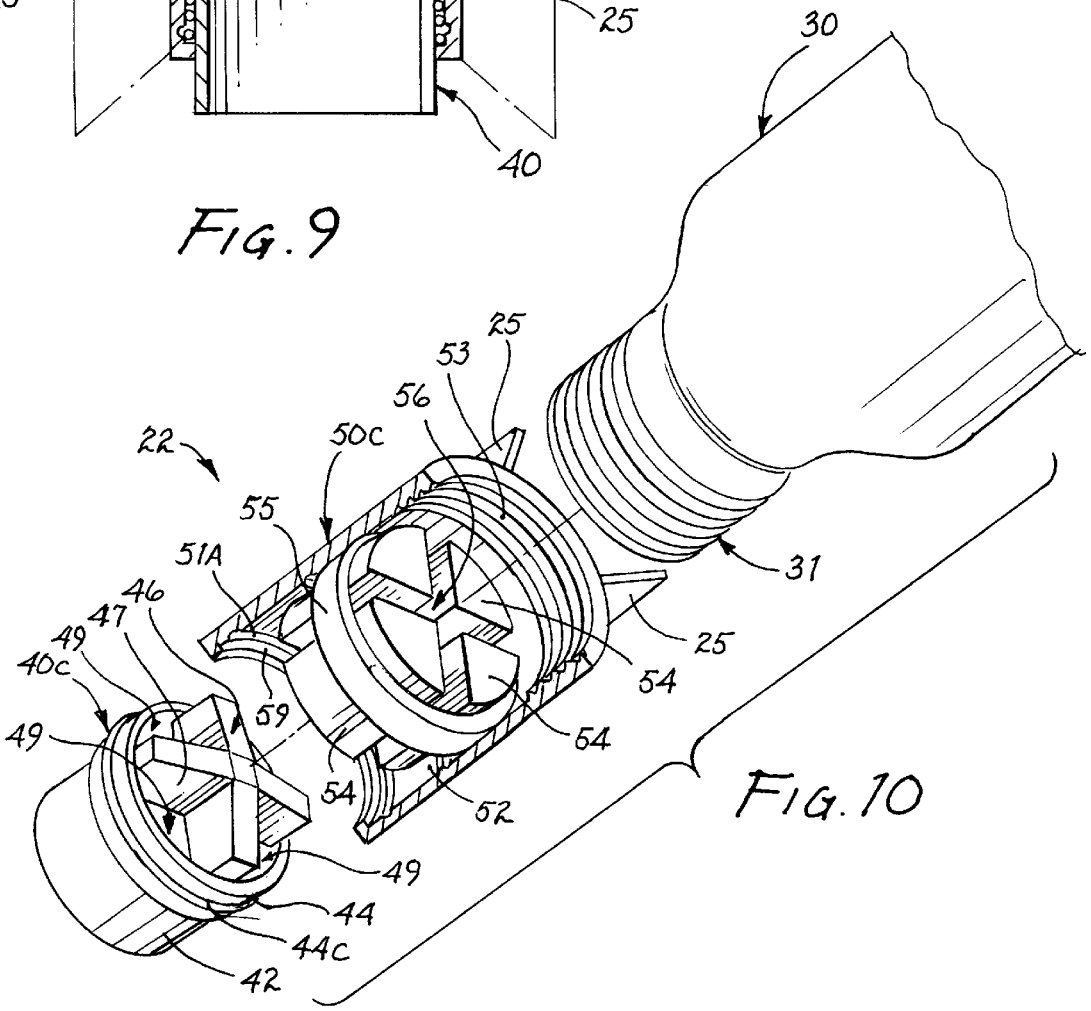
FIG. 10—Exploded partially cut away view of the dispenser apparatus components of the second embodiment wherein the dispenser apparatus is adapted to receive the bottle or container.
Figure 11:
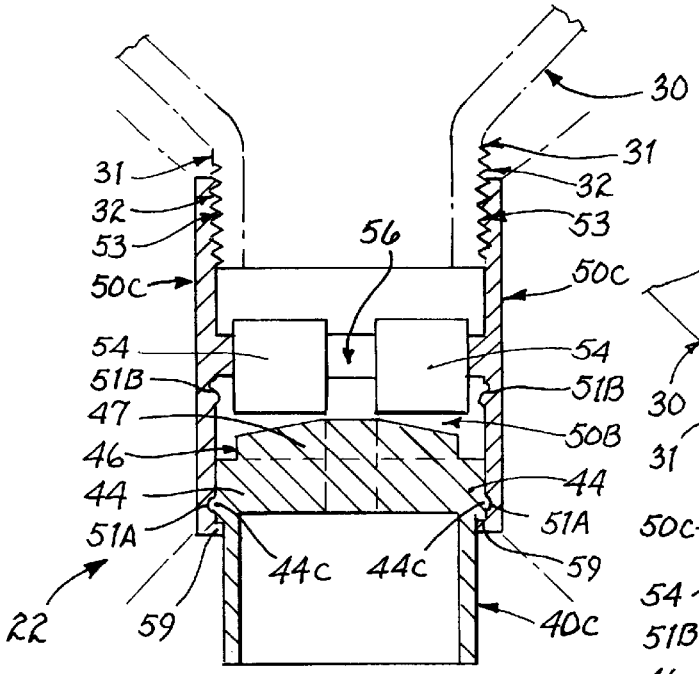
FIG. 11—Cross sectional side view of a third two tier embodiment of the present invention showing the dispenser apparatus in an unlocked and open position.
Figure 12:
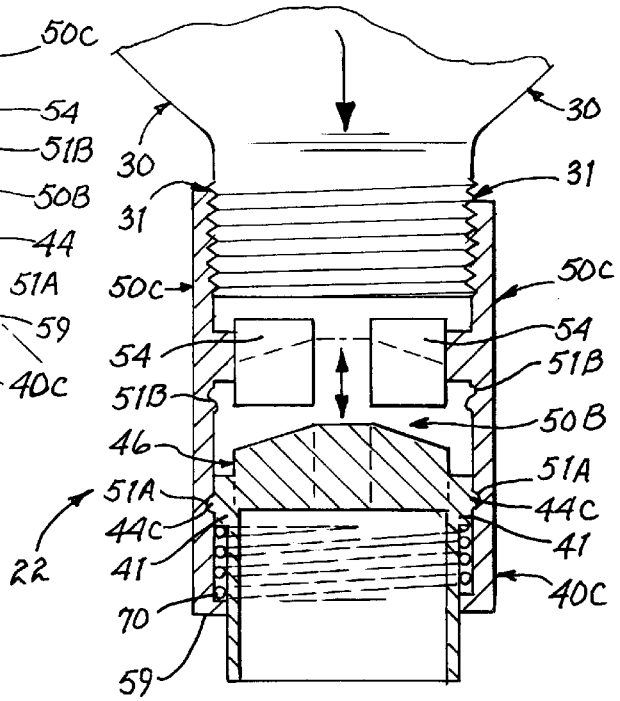
FIG. 12—Cross sectional side view of the third embodiment of FIG. 11 showing an additional spring component within the dispenser apparatus which biasly springs the dispenser apparatus to a closed position.

1. Third Embodiment of the Present Invention—Two Tier Embodiment a. Components of the Third Embodiment The third preferred embodiment of the present invention 10 is a two tier adaptable version embodiment generally having a dispenser apparatus 22 with at least two tier components 40C and 50C (i.e. first and second tier components). FIGS. 10, 11, and 12 show various views of the third embodiment, and these figures show that the third embodiment adaptingly receives the bottle or container 30. Thus, the third embodiment can be referred to as a two tier adaptable version embodiment. FIG. 10 clearly shows a bottle or container 30 and an exploded cutaway view of the two tier components 40C and 50C while FIGS. 11 and 12 clearly show cross-sectional side views of the same bottle/container and components.

1) First Tier Component

The first tier component 40C of the third embodiment is identical to and has all of the same features of the first tier component 40 of the first embodiment except that the first tier component 40C has an additional protruding ring 44C that protrudes from the perimeter surface of protruding area 44. The protruding ring 44C slidingly engages with and into either a groove 51A or a bump and groove 51B depending on the desired position of the first tier component 40C relative to the second tier component 50C.

2) Second Tier Component

The second tier component 50C of the third embodiment is also identical to and has all of the same features of the second tier component 50 of the first embodiment except that a few differences do exist. The second tier component 50C does not have the circular engaging ring 58 but instead has internal threads 53 within a portion of the hollow body 52 to adaptingly and directly receive the threads 32 at end 31 of a bottle or container 30.

Furthermore, the second tier component 50C also has the following additional two features: a groove 51A and a bump and groove 51B. The protruding ring 44C slidingly engages into one of these two features. If the protruding ring 44C is positioned to be engaged into the groove 51A, then the dispenser apparatus 22 is in an unlocked and open position, and the contents of the bottle or container 30 are able to flow out of the dispenser apparatus 22. If the protruding ring 44C is positioned to be engaged into the groove portion of the bump and groove 51B, then the dispenser apparatus 22 is in a locked and closed position. The contents of the bottle or container 30 are entirely prevented from flowing out of the dispenser apparatus 22, and the first tier component 40C is locked in place within second tier component 50C. If the protruding ring 44C is positioned to be disengaged from the groove portion of the bump and groove 51B and positioned near the bump portion of the bump and groove 51B, then the dispenser apparatus 22 is in an unlocked and closed position and the contents of the bottle or container 30 are prevented from flowing out of the dispenser apparatus 22, but they are ready to be dispensed.

Figure 13:
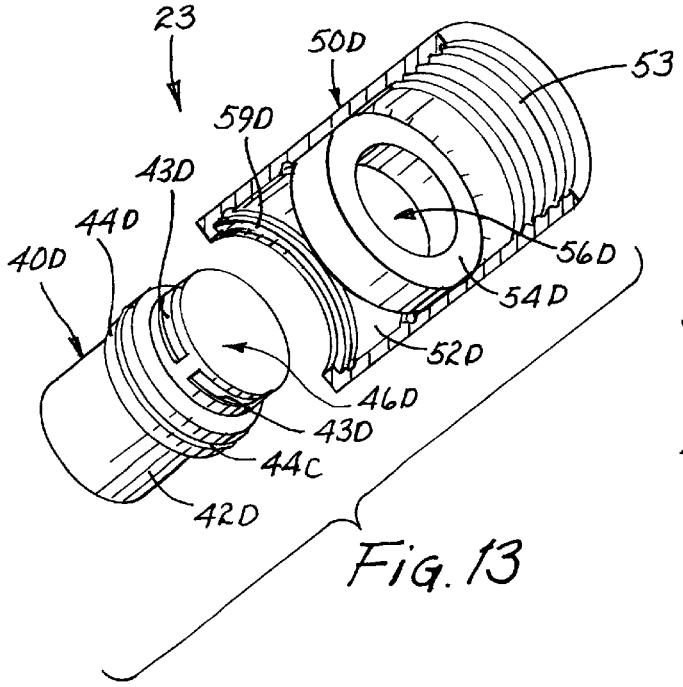
FIG. 13—Exploded partially cut away view of the dispenser apparatus of the third embodiment wherein the dispenser apparatus is adapted to receive the bottle or container.
Figure 14:
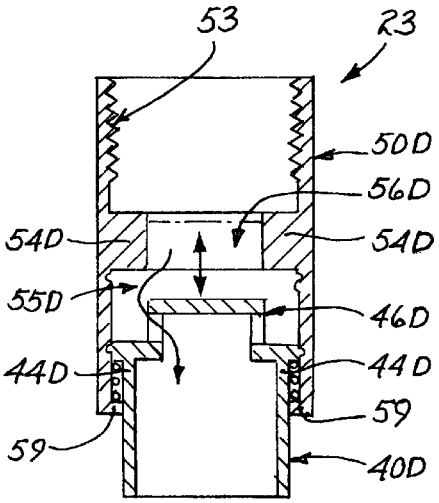
FIG. 14—Cross sectional side view of a fourth two tier embodiment of the present invention showing the dispenser apparatus in an unlocked and open position.

2. Fourth Embodiment of the Present Invention—Two Tier Embodiment a. Components of the Fourth Embodiment The fourth preferred embodiment of the present invention 10 is also a two tier adaptable version embodiment generally having a dispenser apparatus 23 with at least two tier components 40D and 50D (i.e. first and second tier components). FIGS. 13 and 14 show various views of the fourth embodiment which can adaptingly receive the bottle or container 30. FIG. 13 shows an exploded cutaway view of the two tier components 40D and 50D while FIG. 14 shows a cross-sectional side view of the same bottle/container and components.

1) First Tier Component

The first tier component 40D of the fourth embodiment is shown in the figures as a generally cylindrical and hollow body 42D. An annular protruding area 44D exists at an outer end of the hollow body 42D. The first tier component 40D also has a engaging component 46D located relatively near the same end of the protruding area 44D. The engaging component 46D is a cylindrical body that has rectangular openings 43D located at side portions of the cylindrical body. The first tier component 40D also has an additional protruding ring 44C that protrudes from the perimeter surface of protruding area 44D. The protruding ring 44D slidingly engages with and into either a groove 51A or a bump and groove 51B depending on the desired position of the first tier component 40D relative to the second tier component 50D.

2) Second Tier Component

The second tier component 50D also has a generally cylindrical hollow body 52D. The second tier component 50D also has internal threads 53 within a portion of the hollow body 52D to adaptingly and directly receive the threads 32 at end 31 of a bottle or container 30. The inner diameter of the hollow body 52D is slightly larger than the outer diameter of hollow body 42D so that the first tier component 40D is able to slidingly engage within the second tier component 50D. A ring-shaped receiving component 54D that provides a circular opening 56D is centrally located within the hollow body 52.

The second tier component 50D for the fourth embodiment also has the same additional two features that the second tier component for the third embodiment has, that is, the groove 51A and the bump and groove 5B. The protruding ring 44C slidingly engages into one of these two features. If the protruding ring 44C is positioned to be engaged into the groove 51A, then the dispenser apparatus 23 is in an unlocked and open position in which the engaging component 46D is not engaged into the circular opening 56D and a gap 55D exists between the first tier component 40D and the second tier component 50D. The contents of the bottle or container 30 are able to flow through the opening 56D, into the openings 43D, and out of the dispenser apparatus 23.

If the protruding ring 44C is positioned to be engaged into the groove portion of bump and groove 51B, then the dispenser apparatus 23 is in a locked and closed position. The contents of the bottle or container 30 are entirely prevented from flowing out of the dispenser apparatus 23, and the first tier component 40D is locked in place within second tier component 50D. If the protruding ring 44C is positioned to be disengaged from the groove portion of the bump and groove 51B and positioned near the bump portion of the bump and groove 51B, then the dispenser apparatus 23 is in an unlocked and closed position and the contents of the bottle or container 30 are prevented from flowing out of the dispenser apparatus 23, but they are ready to be dispensed.

C. Spring Component for Present Invention

A spring component 70 can also be utilized with the present invention to provide a mechanism for automatically retracting the first tier component back into the second tier component. A person squeezing or applying pressure to the bottle or container 70 provides a force that overcomes the force of the spring component 70, and the spring component 70 stretches out and the first tier component slidingly moves away from the second component and provides an open position for the dispenser apparatus. When the person releases the squeeze or the pressure being applied, the spring component 70 retracts the first tier component back into the second tier component and the dispenser apparatus is then in a closed position.

Figure 17:
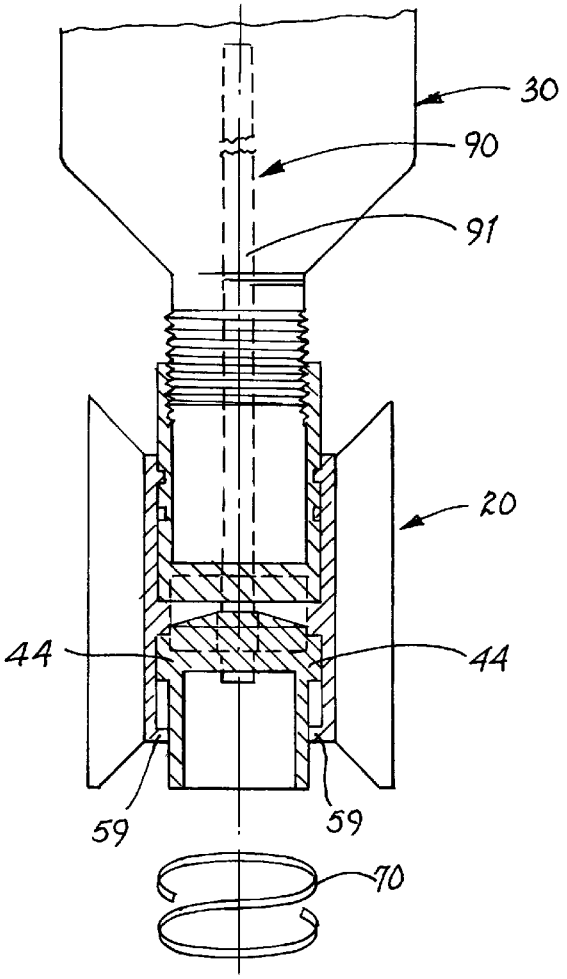
FIG. 17—Cross sectional side view of the first embodiment of the present invention of FIG. 16 which further shows an additional spring component that can be inserted within the dispenser apparatus which biasly springs the dispenser apparatus to a closed position.
Figure 18:
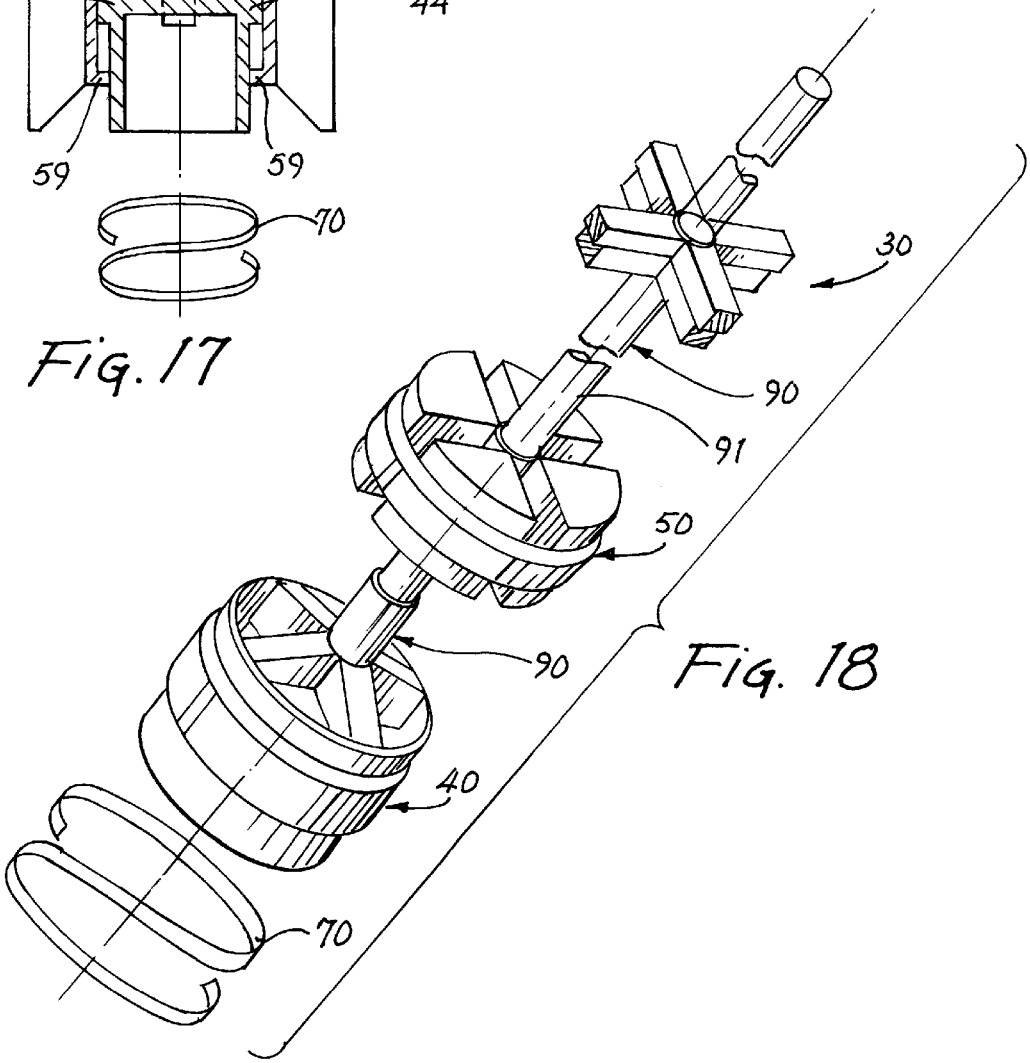
FIG. 18—Exploded perspective view of the internal dispenser apparatus components of the first embodiment of the present invention partially showing the ventilation apparatus and further showing the additional spring component that can be inserted within the dispenser apparatus which biasly springs the dispenser apparatus to a closed position.

FIGS. 12, 17, and 18 show examples of how a spring component 70 can be used with some of the embodiments of the present invention. FIG. 12 shows a two tier embodiment wherein the spring component 70 is located along its height between the protruding area 44 and the retaining ring component 59, and the spring component 70 generally surrounds the cylindrical body 42. Spring component 70 provides spring action between the protruding area 44 and the retaining ring component 59.

FIGS. 17 and 18 show a three tier embodiment of the present invention. Spring component 70 is also located along its height between the protruding area 44 and the retaining ring component 59, and the spring component 70 generally surrounds the cylindrical body 42. Spring component 70 also provides spring action between the protruding area 44 and the retaining ring component 59.

Any suitable spring component or retracting mechanism may also be used with the present invention to provide the retraction of the first tier component within the second tier component, and the present invention is not limited to the spring component nor the methods of use and attachment for the spring component nor the embodiments to which the spring component is attached, that were all disclosed or shown in the figures.

D. Ventilation Mechanism/Ventilation Apparatus

A ventilation mechanism or apparatus is also made part of the present invention since it provides a method or way for ventilating the bottle or container 30 when the bottle or container 30 is squeezed or applied with force to dispense the contents after dispenser apparatus 20 is subsequently placed into a closed position. Therefore, a ventilation mechanism or apparatus is useful in allowing a bottle or container 30 to assume its normal shape or form after it has been squeezed or applied with pressure.

Figure 15:
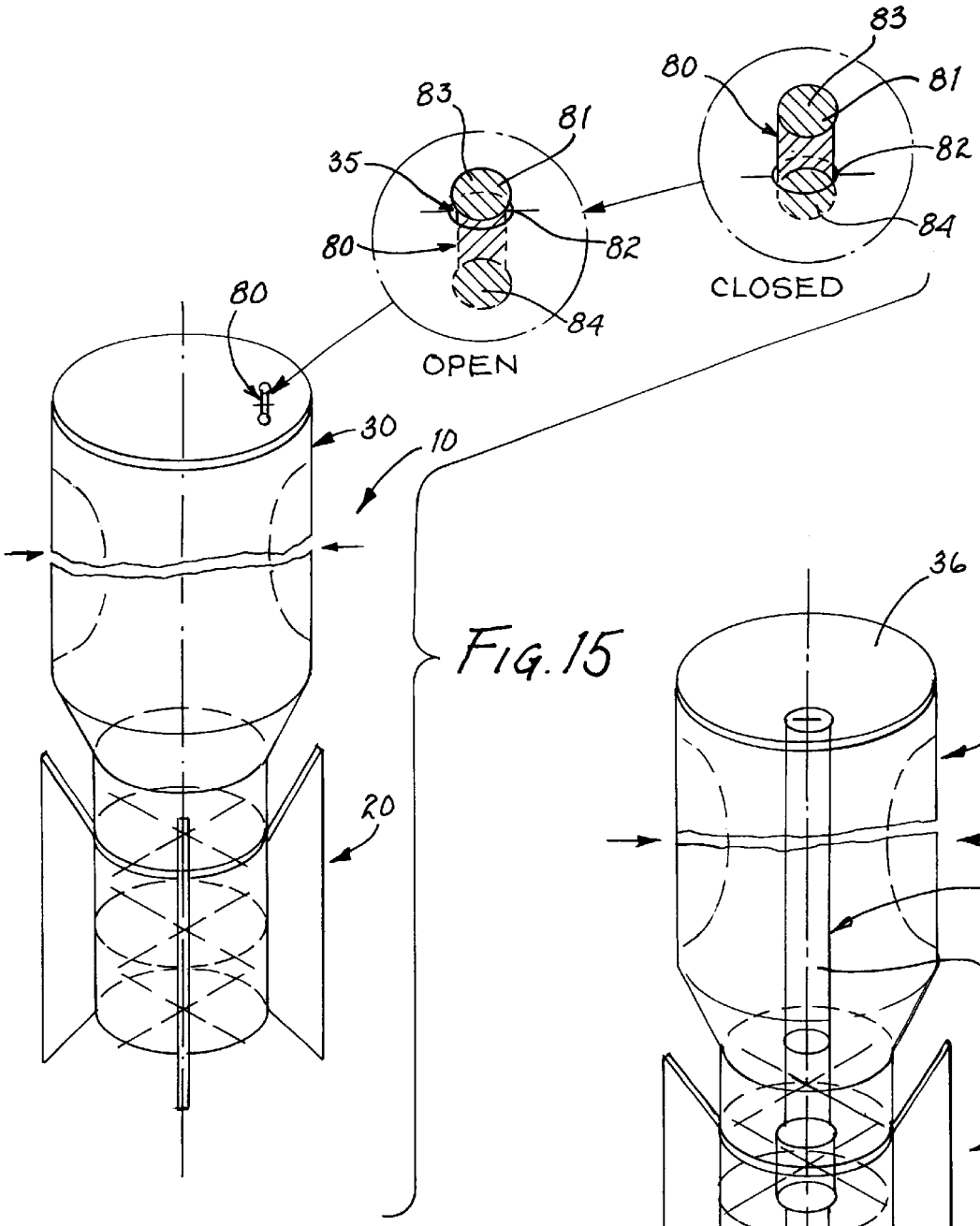
FIG. 15—Perspective view of the first three tier embodiment of the present invention wherein a ventilation mechanism having an open and closed position is located on the bottle.

A ventilation mechanism 80 can also be used with the present invention as shown in FIG. 15. The ventilation mechanism 80 comprises a slide tab 81 with raised ends 83 and 84. The slide tab 81 is slidingly mounted within an opening 35 in the bottle or container 30. One of the raised ends 83 exists outside of the bottle or container 30 while the other raised end 84 is mounted to exist in the inside of the bottle or container 30. A person uses the raised end 83 to slidingly move the slide tab 81 between an open and closed position. The ventilation mechanism 80 is in an open position when the end 83 is positioned relatively near the opening and air is able to enter through the opening 35 (i.e. air can flow around the slide tab 81 and into the opening 35).

The ventilation mechanism 80 is in a closed position when the end 84 that exists inside of the bottle or container 30 is moved to seal the opening 35. The closed position of the ventilation mechanism 80 helps prevent leaking of the contents from the bottle or container 30 and also helps prevent staleness of the contents (i.e. helps keep the freshness) for a longer period of time.

Figure 16:
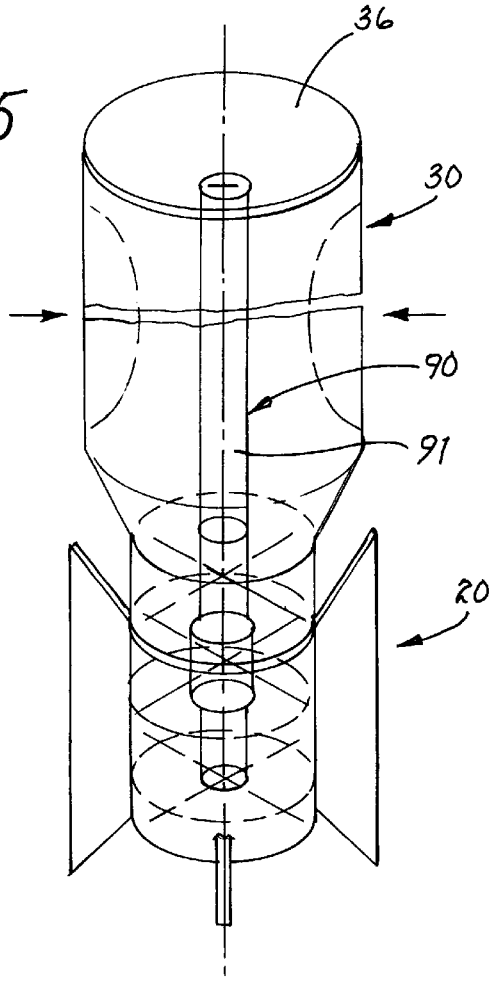
FIG. 16—Perspective view of the first embodiment of the present invention wherein a ventilation apparatus is located inside the bottle along a central axis of the bottle extending from the dispenser apparatus end to near another end of the bottle.

Alternatively, a ventilation apparatus 90 can be used with the present invention as shown in FIGS. 16, 17, and 18. The ventilation apparatus 90 is a hollow tube 91 that is centrally located inside the bottle or container 30 and runs centrally through the dispenser apparatus 20. The hollow tube 91 extends from the dispensing end of the first tier component 40 to the non-dispensing end 36 of the bottle or container 30. When the present invention is in use, the contents of the bottle or container 30 will not be typically filled to reach or touch the interior, non-dispensing side 36, and a space or gap (i.e. where air exists) will exist between the non-dispensing side 36 and the hollow tube 91. Therefore, when the bottle or container 30 is squeezed by a person, then air at the space or gap is able to be ventilated, that is, from inside of the bottle or container 30 and to the outside of the dispenser apparatus (i.e. out of the dispensing end of the first tier component 40 as shown in FIGS. 16 and 17) or vice versa through the hollow tube 91. A valve or diaphram mechanism (i.e. not shown) can also be used within the hollow tube 91 to further help prevent any possible leaking or staleness of the contents problem.

E. Methods of Use of the Present Invention

A person uses one of the three tier embodiments of the present invention by unlocking the second tier component 50 from the third tier component 60 by disengaging the retaining ring 58 of the second tier component 50 from the groove 64 and engaging it into the circular groove 68. The protruding area 44 of the first tier component 40 is in contact with the annular component 55 of the second tier component 50 so that the dispenser apparatus 20 or 21 is in a closed position. The person then lifts the bottle or container 30 and squeezes it so that the first tier component 40 slidingly moves so that the protruding area 44 is in contact with the retaining ring 59 and the dispenser apparatus 20 or 21 is then in an open position. After the person finishes squeezing the bottle or container 30 for dispensing a desired amount of contents, then the person releases the bottle or container 30. The bottle or container 30 is set down on a surface so that the first tier component 40 slidingly moves so that the protruding area 44 is again in contact with the annular component 55 and the dispenser apparatus 20 or 21 is in a closed position. Alternatively, if a spring component 70 is used within the dispenser apparatus 20 or 21, then the squeezing force must overcome the force of the spring 70. After a person uses the bottle or container 30 having a dispenser apparatus with a spring 70 and releases the pressure or squeeze on it, then the first tier component 40 automatically retracts within the second tier component 50.

A person uses one of the two tier embodiments of the present invention by unlocking the first tier component 40C or 40D from the second tier component 50C or 50D by disengaging the annular protruding area 44C of the first tier component 40C or 40D from the bump and groove 51B and engaging it into the groove 51A. The protruding area 44C of the first tier component 40 is disengaged from the bump and groove 51B but is still adjacent to it so that the dispenser apparatus 22 or 23 is in a closed position and the contents of the bottle or container 30 are ready to be dispensed. The person then lifts the bottle or container 30 and squeezes it so that the first tier component 40C or 40D slidingly moves to the retaining ring 50 so that the protruding area 44C slides into contact and engages with the groove 51A and the dispenser apparatus 22 or 23 is then in an open position. After the person finishes squeezing the bottle or container 30 for dispensing a desired amount of contents, then the person releases the bottle or container 30 and the bottle or container 30 is set down on a surface so that the first tier component 40C or 40D slidingly moves so that the protruding area 44C is near but not engaged into the bump and groove 51B and the dispenser apparatus 22 or 23 is in a closed position. If a spring component 70 is used within the dispenser apparatus 22 or 23, then the squeezing force must overcome the force of the spring 70. After a person uses the bottle or container 30 having a dispenser apparatus with the spring 70 and releases the pressure or squeeze on it, then the first tier component 40 automatically retracts within the second tier component 50.

The foregoing description and specifications of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

The present invention is preferably made from a plastic material. However, any suitable material may be utilized for carrying out the purposes of the present invention, which is not limited to those described in the specification. Furthermore, the bottle or container, the dispenser apparatuses, the tier components, the support components, the spring components, the ventilation mechanism or apparatuses, the number of tier components used, the integrally attached and adaptable version aspects of the dispenser apparatus to the bottle or container, and other features of these components or of any other components used in conjunction with the present invention have been presented as the preferred components for present invention in this application. However, the present invention is not in any way limited to these components and features, and any suitable components may be utilized for carrying out the purposes of the present invention. Also, in its preferred form, applicant uses the number of components as presented in the specification and figures. However, with appropriate knowledge and application of that knowledge to those of ordinary skill in the art, some of these components can be combined into a single component. Furthermore, the preferred shapes and forms of the components for the present invention have been presented in the specification and figures. However, any suitable shapes and forms of these components may be utilized for carrying out the purposes of the present invention, which is not limited to those shown or described in the specification and figures. The contents used with the present invention are preferably liquids, fluids, or other such viscous flowing substances. However, any suitable contents may be used in conjunction with the present invention, which is not limited to those shown or described in the specification.

Likewise, any use of the words "function" or "means" in the Detailed Description is not intended to indicate a desire to invoke the special provisions of 35 U.S.C. Sec. 112, Paragraph 6 to define his invention. To the contrary, if the provisions of 35 U.S.C. Sec. 112, Paragraph 6 are sought to be invoked to define the invention, the claims will specifically state the phrases "means for" or "step for" and a function, without reciting in such phrases any structure, material, or act in support of the function. Even when the claims recite a "means for" or "step for" performing a function, if they also recite any structure, material, or acts in support of that means or step, then the invention is not to invoke the provisions of 35 U.S.C. Sec. 112, Paragraph 6. Moreover, even if the inventors invoke the provisions of 35 U.S.C. Sec. 112, Paragraph 6 to define the invention, it is the intention that the invention not be limited only to the specific structure, material, or acts that are described in his preferred embodiment. Rather, if the claims specifically invoke the provisions of 35 U.S.C. Sec. 112, Paragraph 6, it is nonetheless the intention to cover and include any and all structures, materials, or acts that perform the claimed function, along with any and all known or later developed equivalent structures, materials, or acts for performing the claimed function.

I claim:

1. An inverted bottle support and dispenser apparatus for allowing a bottle having contents therein to be set in an inverted position on a surface comprising:

at least two tier components that are adapted to be attached to a dispensing end of the bottle wherein one of the at least two tier components slidingly moves within another of the at least two components and wherein the at least two components can move to an open position for dispensing the contents from the bottle and to a closed position to allow the contents to remain in the bottle, a support surface coupled to the at least two tier components to support the bottle in the inverted position, and a direct ventilation mechanism coupled to the at least two tier components to directly ventilate air in the bottle while the bottle is still in the inverted position.

2. The inverted bottle support and dispenser apparatus according to claim 1:

wherein the at least two tier components are a first tier component, a second tier component, and a third tier component, wherein the third tier component is adapted to attach to the dispensing end of the bottle, wherein the second tier component is able to be slidingly positioned relative to the third tier component to provide an unlocked position and a locked position for the apparatus, and wherein the first tier component is able to slidingly move within the second tier component to provide an open position and a closed position for the apparatus.

3. The inverted bottle support and dispenser apparatus according to claim 2 wherein the first tier component further comprises:

a generally cylindrical and hollow body having an outer diameter slightly smaller than an inner diameter of the second tier component, an annular protruding area located on a surface at an end of the hollow body that slides within the second tier component, and a cross-shaped engaging component mounted at the end of the hollow body providing openings wherein the engaging component engages with the second tier component to provide the open position and the closed position.

4. The inverted bottle support and dispenser apparatus according to claim 2 wherein the second tier component further comprises:

a generally cylindrical and hollow body having an inner diameter slightly larger than outer diameters of the first tier component and the second tier component, a receiving component centrally located within the hollow body wherein the receiving component has a channel opening to which an engaging component from the first tier component engages to provide the open position and the closed position and to which an engaging component from the third tier component engages to provide the unlocked position and the locked position, and a circular engaging ring that engages with grooves within the third tier component that position the second tier component and the third tier component to the unlocked position and the locked position.

5. The inverted bottle support and dispenser apparatus according to claim 2 wherein the third tier component further comprises:

a generally cylindrical and hollow body having an outer diameter slightly smaller than an inner diameter of the second tier component, an engaging component mounted at an end of the hollow body wherein the engaging component is in a shape of a cross that has openings and engages with the second tier component, a first circular groove located in an exterior perimeter of the hollow body that allows the second tier component and the third tier component be positioned in the locked position, and a second circular groove located in an exterior perimeter of the hollow body that allows the second tier component and the third tier component be positioned in the unlocked position.

6. The inverted bottle support and dispenser apparatus according to claim 1:

wherein the at least two tier components are a first tier component and a second tier component, wherein the second tier component is adapted to attach to the dispensing end of the bottle, wherein the first tier component is able to be slidingly positioned relative to the second component to provide an unlocked position and a locked position for the apparatus, and wherein the first tier component is able to slidingly move within the second tier component to provide an open position and a closed position for the apparatus.

7. The inverted bottle support and dispenser apparatus according to claim 6 wherein the first tier component further comprises:

a generally cylindrical and hollow body having an outer diameter slightly smaller than an inner diameter of the second tier component, an annular protruding area located on a surface at an end of the hollow body that slides within the second tier component, a cross-shaped engaging component mounted at the end of the hollow body providing openings wherein the engaging component engages with the second tier component to provide the open position and the closed position, and a protruding ring located around a perimeter surface of the protruding area to slidingly engage into a groove and a bump and groove feature in the second tier component to provide the unlocked position and the locked position.

8. The inverted bottle support and dispenser apparatus according to claim 6 wherein the second tier component further comprises:

a generally cylindrical and hollow body having an inner diameter slightly larger than an outer diameter of the first tier component, a receiving component centrally located within the hollow body wherein the receiving component has a channel opening to which an engaging component from the first tier component engages to provide the open position and the closed position, a circular groove located in an interior perimeter of the hollow body that allows the first tier component and the second tier component be positioned to the unlocked position and the open position, and a circular bump and groove feature located in an interior perimeter of the hollow body that allows the first tier component and the second tier component be positioned in the unlocked position and the closed position and that allows the first tier component and the second tier component be engaged into the locked position and the closed position.

9. The inverted bottle support and dispenser apparatus according to claim 1 further comprising:

at least one bottle support component coupled to the at least two tier components to provide the support surface which supports the bottle in the inverted position.

10. The inverted bottle support and dispenser apparatus according to claim 9 wherein the at least one bottle support component comprises fins coupled to the at least two tier components for providing a stand component for supporting the bottle in the inverted position.

11. The inverted bottle support and dispenser apparatus according to claim 9 wherein the at least one bottle support component comprises a circular stand component coupled to the at least two tier components for supporting the bottle in the inverted position.

12. The inverted bottle support and dispenser apparatus according to claim 1 further comprising:

a spring component mounted within the at least two tier components for automatically retracting and biasly springing one of the at least two tier components to another of the at least two tier components.

13. The inverted bottle support and dispenser apparatus according to claim 1 wherein the direct ventilation mechanism further comprises:

a hollow tube that is centrally attached through the at least two tier components and that can generally extend from a dispensing end of the at least two tier components to a non-dispensing end of the bottle.

14. The inverted bottle support and dispenser apparatus according to claim 1 wherein:

the bottle is coupled to the at least two tier components, and the direct ventilation mechanism is a slide-tab ventilation mechanism attached to the bottle so that air in the bottle is directly ventilated while the bottle is still in the inverted position.

15. A method of making an inverted bottle support and dispenser apparatus for allowing a bottle having contents therein to be set in an inverted position on a surface comprising the steps of:

providing at least two tier components that are adapted to be attached to a dispensing end of the bottle wherein one of the at least two tier components slidingly moves within another of the at least two components and wherein the at least two components can move to an open position for dispensing the contents from the bottle and to a closed position to allow the contents to remain in the bottle, coupling a support surface to the at least two tier components to support the bottle in the inverted position, and coupling a direct ventilation mechanism to the at least two tier components to directly ventilate air in the bottle while the bottle is still in the inverted position.

16. The method of making an inverted bottle support and dispenser apparatus according to claim 15:

wherein the providing step further comprises the step of providing a first tier component, a second tier component, and a third tier component, wherein the third tier component is adapted to attach to the dispensing end of the bottle, wherein the second tier component is able to be slidingly positioned relative to the third tier component to provide an unlocked position and a locked position for the apparatus, wherein the first tier component is able to slidingly move within the second tier component to provide an open position and a closed position for the apparatus.

17. The method of making an inverted bottle support and dispenser apparatus according to claim 15:

wherein the providing step further comprises the step of providing a first tier component and a second tier component, wherein the second tier component is adapted to attach to the dispensing end of the bottle, wherein the first tier component is able to be slidingly positioned relative to the second component to provide an unlocked position and a locked position for the apparatus, and wherein the first tier component is able to slidingly move within the second tier component to provide an open position and a closed position for the apparatus.

18. A method of using an inverted bottle support and dispenser apparatus for allowing a bottle having contents therein to be set in an inverted position on a surface comprising the steps of:

providing a dispenser apparatus having at least two tier components which slidingly move relative to each other and having a support surface coupled to the at least two tier components to support the bottle in the inverted position and having a direct ventilation mechanism coupled to the at least two tier components to directly ventilate air in the bottle while the bottle is still in the inverted position, and attaching the dispenser apparatus to the bottle, slidingly positioning the at least two tier components to an unlocked and open position for dispensing a desired amount of the contents from the bottle, squeezing the bottle to allow a desired amount of the contents to flow from the bottle when the dispenser apparatus is in the unlocked and open position, releasing squeezing pressure on the bottle which allows the direct ventilation mechanism to directly ventilate air in the bottle while the bottle is still in the inverted position, further squeezing the bottle if more contents are desired to be dispensed from the bottle.

slidingly positioning the at least two tier components to an unlocked and closed position for preventing the contents from flowing out of the bottle and positioning the contents within the bottle and dispenser apparatus to a ready dispensing position, and slidingly positioning the at least two tier components to a locked and closed position for preventing the contents from entirely flowing out of the bottle.

19. The inverted bottle support and dispenser apparatus according to claim 13 further comprising:

a valve mechanism coupled to the direct ventilation mechanism for allowing the hollow tube to be in an open air passage position to the bottle and a closed air passage position to the bottle.

20. An inverted bottle support and dispenser apparatus for allowing a bottle having contents therein to be set in an inverted position on a surface comprising:

at least three tier components that are adapted to be attached to a dispensing end of the bottle wherein the at least three tier components slidingly move within each other and wherein the at least three components can move to an open position to allow the contents to remain in the bottle, and a support surface coupled to the at least three tier components to support the bottle in the inverted position, wherein the at least three tier components are a first tier component, a second tier component, and a third tier component, wherein the third tier component is adapted to attach to the dispensing end of the bottle, wherein the second tier component is able to be slidingly positioned relative to the third tier component to provide an unlocked position and a locked position for the apparatus, and wherein the first tier component is able to slidingly move within the second tier component to provide an open position and a closed position for the apparatus.

* * * * *